US005407492A

United States Patent [19]

Ohmi et al.

[11] Patent Number: 5,407,492

[45] Date of Patent: Apr. 18, 1995

[54] PROCESS FOR FORMING PASSIVATED FILM

[75] Inventors: Tadahiro Ohmi, Sendai; Yoshiyuki Nakahara, Osaka; Takashi Sakanaka, Tsurugashima; Eiji Ohta, Amagasaki; Satoshi Mizokami, Chiba, all of Japan

[73] Assignee: Osaka Sanso Kogyo Ltd., Osaka, Japan

[21] Appl. No.: 81,353

[22] PCT Filed: Feb. 18, 1992

[86] PCT No.: PCT/JP92/00160

§ 371 Date: Jun. 23, 1993

§ 102(e) Date: Jun. 23, 1993

[87] PCT Pub. No.: WO92/14858

PCT Pub. Date: Sep. 3, 1992

[51] Int. Cl.[6] ..... C23C 8/10

[52] U.S. Cl. ..... 148/287; 422/7; 148/606

[58] Field of Search ..... 148/287, 606; 422/7

[56] References Cited

FOREIGN PATENT DOCUMENTS

| | | |
|---|---|---|
| 63-169391 | 7/1988 | Japan . |
| 64-31956 | 2/1989 | Japan . |
| 1-087760 | 3/1989 | Japan . |
| 1-198463 | 8/1989 | Japan . |
| 1-198465 | 8/1989 | Japan . |
| 2-43353 | 2/1990 | Japan . |

*Primary Examiner*—Richard O. Dean
*Assistant Examiner*—Margery S. Phipps
*Attorney, Agent, or Firm*—David M. Rosenblum; Larry R. Cassett

[57] ABSTRACT

A process for a passivated film which is far reduced in the amount of gas discharge and can desorb an adsorbed gas more readily, which process comprises heating a stainless member with a surface roughness, Rmax, of 1.0 μm or less in an atmosphere of a mixture comprising oxygen gas and an inert gas and having a dew point of −95° C. or below, an impurity concentration of 10 ppb or less and an oxygen content 5 ppm 25 vol % at 300° to 420° C.

4 Claims, 5 Drawing Sheets

PROCESS FOR FORMING PASSIVATED FILM

TECHNOLOGICAL FIELD

The present invention relates to a process for forming passivated film, and in particular relates to a process for forming passivated film which is capable of forming a passivated film which has an extremely small release of moisture, and which is capable of conducting the desorption of adhering moisture in an extremely short period of time.

BACKGROUND ART

In recent years, technologies which realize ultrahigh-grade vacuums, and technologies which create ultraclean low pressure atmospheres by means of the inflow of small amounts of specified gasses into a vacuum chamber, have become extremely important.

Such technologies are widely used in research into the characteristics of materials, the formation of various types of thin films, and the production of semiconductor devices, and therefore higher and higher degrees of vacuum are being realized; however, furthermore, the realization of a low pressure atmosphere in which contamination by impurity elements or impurity molecules is limited to an extreme degree has been greatly desired.

For example, to use the example of semiconductor devices, as a result of the increase in the degree of integration of integrated circuits, the dimensions of the unit elements have become smaller each year, and as semiconductor devices having dimensions such that the spaces between elements have gone from a level of 1 micrometer to a submicrometer level, and further to a level less than 0.5 micrometers, have come into common use, research and development in this area has been conducted on a large scale.

The production of this type of semiconductor device is accomplished by means of the repetition of a process in which a thin film is formed, and a process in which this thin film is subjected to etching in a specified circuit pattern. It is common for this type of process to be conducted in an ultrahigh vacuum state or in a low pressure atmosphere in which a specified gas is introduced, by means of placing a silicon wafer in a vacuum chamber. In such processes, if contamination with impurities is present, for example, problems will be caused in that the quality of the thin film will be reduced, and sufficient accuracy will not be obtainable in the very detailed treating. This the reason why an ultrahigh vacuum and an ultraclean low pressure atmosphere have been desired.

One of the greatest obstacles to the realization of an ultrahigh vacuum or an ultraclean low pressure atmosphere has, up until now, been gas which was discharged from the stainless steel surface which is widely used in the chamber and in the gas pipes. In particular, it has been determined that the greatest source of contamination is from moisture which adsorbs to the surface and desorbs in a vacuum or in a low pressure atmosphere.

FIG. 5 is a graph showing the relationship between gas contamination and the total leak amount (the sum of the discharge gas amount from the surfaces of the pipe system and the interior of the reaction chamber and external leaks) of a system in a conventional device in which a gas pipe system and a reaction chamber are combined. The plurality of lines in the drawing indicate cases in which the flow amount of the gas is changed to various values as a parameter.

Semiconductor processing is exhibiting a tendency to reduce the gas flow amounts to a greater and greater extent in order to realize highly accurate processing; for example, it has now become common to use flow amounts of 10 cc/min or less.

Assuming a flow amount of 10 cc/min, if, as in presently widely used devices, a system total leakage on the order of $10^{-3-10-6}$ Torr.l/sec is present, the gas purity will be 10 ppm-1%, which is well outside highly clean processing ranges.

The present inventors have invented a ultrahigh-purity gas supply system which has succeeded in reducing the leakage amount from the exterior of the system to a level of less than $1\times10^{-11}$ Torr.l/sec, which is below the detecting threshold of present detectors.

However, as a result of leaks from the interior of the system, that is to say, as a result of gas components discharged from the above-described stainless steel surfaces, it has been impossible to reduce the impurity concentration of the low pressure atmosphere. The minimum value of the surface discharged gas amount obtained by means of the surface treating available in the present ultrahigh vacuum technology is $1\times10^{-11}$ Torr.l/sec.cm$^2$ in the case of stainless steel, and even if the surface area which is exposed in the interior of the chamber is estimated at a value which is as small as possible, for example, 1 m$^2$, a total leakage amount of $1\times10^{-7}$ Torr.l/sec results, and a gas having a purity of only approximately 1 part per million with respect to a gas flow amount of 10 cc/min can be obtained. If the gas flow amount is further reduced, it is of course obvious that the purity will further decline.

In order to reduce the degassing component from the inner surfaces of the chamber to a level of approximately $1\times10^{-11}$ Torr.l/sec, which is equal to the external leakage amount of the total system, it is necessary to reduce degassing from the stainless steel surfaces to less than $1\times10^{-15}$ Torr.l/sec.cm$^2$; for this reason, a stainless steel surface treating technique which can reduce the gas discharge amount has been greatly desired.

On the other hand, in semiconductor production processes, a great variety of gasses are in use, from relatively stable common gasses ($O_2$, $N_2$, Ar, $H_2$, He), to rare gasses having great reactivity, corrosivity, and toxicity. In particular, if moisture is present in the atmosphere in a special gas, this may hydrolyze, producing hydrochloric acid or hydrofluoric acid, and boron trichloride ($BCl_3$) and boron trifluoride ($BF_3$) and the like, which exhibit strong corrosivity, will be present. Normally, stainless steel is used as a material for pipes and chambers handling such gasses, in view of its reactivity, resistance to corrosivity, high strength, ease of secondary working, ease of welding, and ease of polishing the inner surfaces thereof.

However, although stainless steel has superior resistance to corrosion in an atmosphere of dry gas, it corrodes easily in an atmosphere of a chlorine or fluorine system gas in which moisture is present. As a result, it is necessary to conduct corrosion resistant treating after the surface polishing of the stainless steel. Among such treatings, coating of a metal which has superior resistance to corrosion, such as Ni—W—P, onto the stainless steel is known; however, in this method, not merely are cracks and pin holes and the like easily caused, but as this is a method which uses wet plating, there are problems in that the amount of moisture adsorption or the residual solution component on the inner surface is large, and the like.

An example of another method is corrosion resistant treating by means of passivation treating which creates a thin oxide film on a metal surface. If sufficient oxidizer is present in a liquid, stainless steel can be passivated simply by means of immersion, so that normally, passivation treating is conducted by means of immersion in a nitric acid solution at normal temperatures.

However, this method is also a wet method, so that moisture and residual plating solution are present in large amounts on the pipes and on the inner surface of the chamber. In particular, in the case in which the moisture discharges chlorine system and fluorine system gasses, severe damage is caused to the stainless steel.

Accordingly, the construction of a chamber or gas pipe system by means of stainless steel having formed thereon a passivated film which does not receive damage even from corrosive gasses and which has low occlusion and adsorption of moisture is extremely important in very high vacuum technologies and in semiconductor processing; however, previously, this type of technology has not been available.

The present applicants have, on Feb. 4, 1988, filed a patent application Japanese Patent number 2459/88 for a stainless steel member, wherein the percentage of Ni atoms in an outer layer of an oxide film formed on a stainless steel member surface which was subjected to electrolytic polishing treating is less than 2%, and the percentage of Cr atoms in an inner layer thereof is more than 30%, and the thickness of this oxide film is within a range of 10–50 nm, and for a stainless steel member and production method, wherein heat treating is conducted in an atmosphere of an oxide gas having a moisture dew point of from −10° C.-<−105° C. (Applicant: Tadahiro Ohmi)

This stainless steel member enables the simple conducting of desorption of the moisture by means of conducting appropriate baking, even if moisture adheres or is adsorbed, and this stainless steel member also has a small gas discharge amount from the member itself.

However, as the effects on the characteristics of the semiconductor processing and the like which are caused by the purity of the treating gas have become clearer, and as it has come to be understood that as the purity increases, devices with greater abilities can be obtained, the development of a stainless steel member which has an even smaller gas discharge amount, and furthermore, is able to more easily control the discharge of adsorbed gasses, has been strongly desired.

DISCLOSURE OF THE INVENTION

The process for forming a passivated film of the present inventors, which solves the above problems, forms a passivated film by means of the heating of a stainless steel member, having a surface roughness value Rmax which is less than 1.0 micrometers, to a temperature of 300°–420° C. in a mixed gas atmosphere in which an oxygen gas containing oxygen at a rate of 5 ppm-25 vol % and an inert gas are mixed, wherein the dew point is less than −95° C., and the impurity concentration is less than 10 parts per billion.

Function

The present inventors have conducted research into the development of a stainless steel member which further reduces the discharge of moisture. As a result, they have discovered that if the formation of a passivated film is conducted under specified conditions, a passivated film comprising an amorphous oxide can be formed, and furthermore, when this passivated film was tested, it was discovered that the film possesses minuteness and that the resistance to gas discharge thereof represents an improvement over that of the stainless steel member for which a patent was previously sought.

The present invention is based on the above discoveries; hereinbelow, it will be explained in detail.

In the present invention, the surface roughness Rmax of the stainless steel member is set to a level of below 1.0 micrometers. If the value of Rmax exceeds 1.0 micrometers, the oxide film which is formed is lacking in minuteness, so that the expected increase in gas discharge resistance cannot be realized. In the range of Rmax below 1.0 micrometers, the range of 0.1 micrometers–0.5 micrometers is further preferable. If the maximum value of the difference in height between convexities and concavities in a circular region having a radius of 0.5 micrometers at any freely selected location is set to a value less than 1 micrometer, minuteness is further improved, and the formation of a passivated layer having a small gas discharge is possible. Furthermore, if the adjustment of the surface roughness is accomplished, for example, by electrolytic polishing, even if a deformed layer is present, this deformed layer will be eliminated, and the adsorption of gas to this deformed layer can be prevented, so that this is preferable.

On the other hand, in the present invention, the dew point of the atmospheric gas is set lower than −95° C. By means of the limitation of the dew point to a temperature which is less than −95° C., as stated hereinbelow, the restriction of the impurity concentration and the heating temperature are aided, and by means of the minuteness, it becomes possible to form an amorphous passivated film which has superior resistance to gas discharge. If the dew point exceeds a temperature of −95° C., the passivated film will not have sufficient minuteness and the resistance to gas discharge will be poor. The fact that if the dew point exceeds the temperature of −95° C., the minuteness of the passivated film will be insufficient, and the resistance to gas discharge will deteriorate, was discovered by the present inventors. A temperature of less than −110° C. is still further preferable.

On the other hand, in the present invention, heat treating is conducted in an atmosphere of a mixed gas in which an oxygen gas containing oxygen at a rate of 5 ppm-20 vol % and an inert gas are mixed.

In the present invention, it is possible to form an amorphous passivated film which has sufficient minuteness even with an oxygen amount of 5 ppm-20 vol % by means of the controlling of the dew point and of impurities. However, at levels of less than 5 ppm, the amount of oxygen is insufficient, and the formation of a satisfactory oxide film is difficult. Furthermore, if 20 vol % is exceeded, the resistance to gas discharge worsens.

On the other hand, the impurity concentration in the atmospheric gas is set to a total level of less than 10 ppb. A level of 5 ppb or less is preferable, while a level of 1 ppb or less is still further preferable. If a level of 10 ppb is exceeded, the passivated film will not possess sufficient minuteness even if the other conditions are within the ranges of the present invention.

The heating for the purpose of passivated film formation is conducted at a temperature within a range of 300°–420° C. At temperatures less than 300° C., the temperature is too low and an oxide film possessing sufficient vertical density cannot be formed. When the temperature exceeds 420° C., a crystalline passivated film is formed. Accordingly, the heat temperature is within a range of 300°–420° C.

The heating period varies with the the heating temperature, however, a period of more than 30 minutes is preferable.

The passivated film formed according to the above method normally has a thickness of 10–20 nm, and comprises an amorphous oxide which is rich in Cr atoms on the side of the member.

PREFERRED FORM FOR THE EXECUTION OF THE INVENTION

The inner surface of a SUS316L stainless steel pipe having an outer diameter of 12.7 mm, a thickness of 1 mm, and a length of 2 m was subjected to electrolytic polishing using an aqueous solution of $H_2SO_4$-$H_3PO_4$, and the surface roughness thereof was brought within a range of 0.1–1.0 micrometers. Furthermore, the largest value of the difference in height between concave portions and convex portions within a 5 micrometer radius was set to a value of less than 1.0 micrometers.

Figure 1:
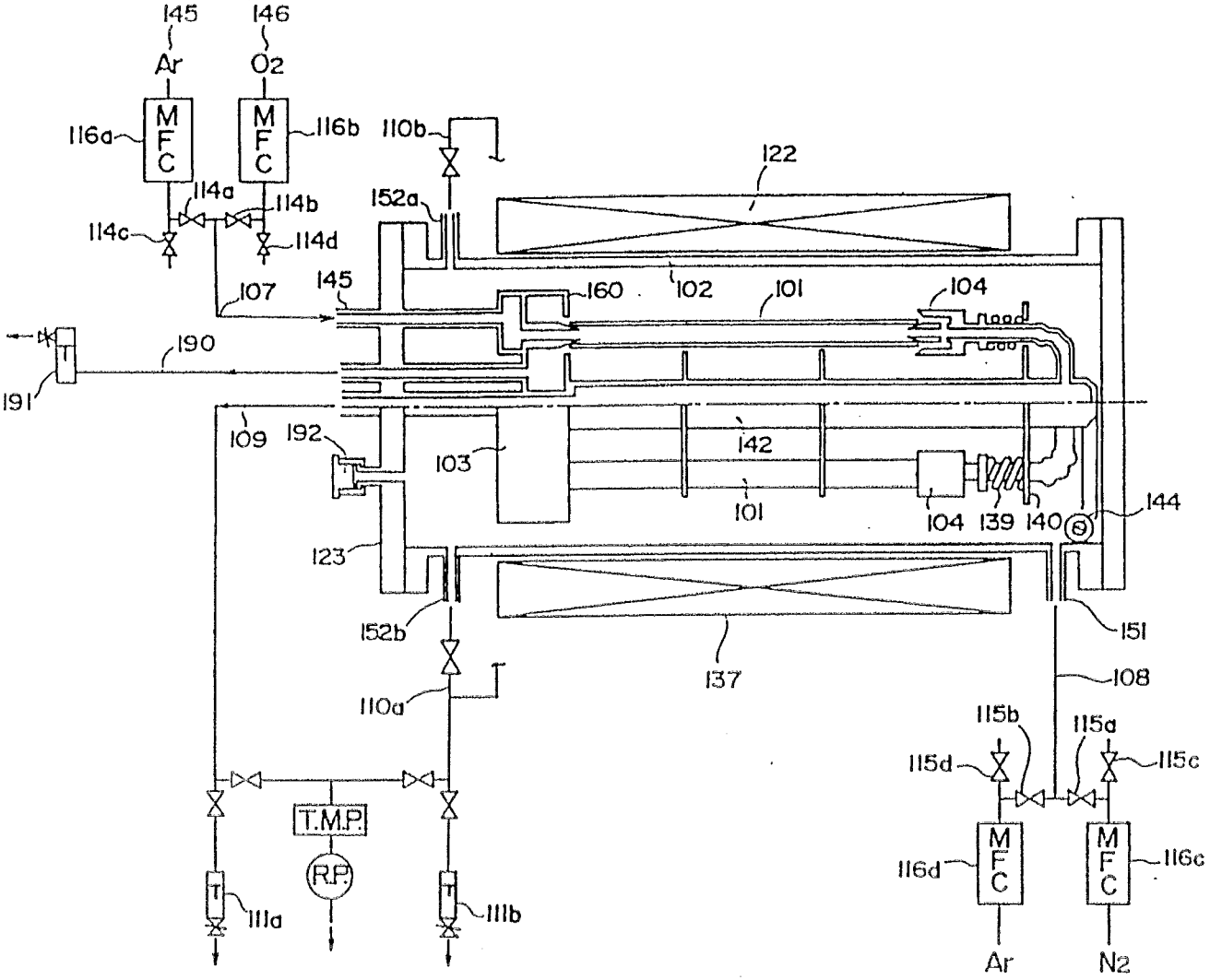
FIG. 1 is a conceptual diagram showing an example of a device for the purpose of conducting passivating treating.

The stainless steel pipe was placed in the device shown in FIG. 1, and the formation of a passivated film was conducted. Reference numeral 101 indicates the stainless pipe in FIG. 1. Reference numeral 105 indicates a header; a plurality of gas input ports 110 are formed on header 105. A taper is provided on the outer circumference of the lead end of input ports 110, and it is possible to support the stainless steel pipe 101 in these tapered portions.

Reference numeral 103 indicates an inert gas source (in the present example, an Ar gas source), and reference numeral 104 indicates an oxygen source, and the gasses from inert gas source 103 and oxygen gas source 104 are mixed through the medium of mass flow controllers 105 and 106, and this flows into the interior of the stainless steel pipe 101 from input port 110. By means of this device, the impurity concentration of the gas which is supplied to the interior of the stainless steel pipe can be reduced to a level of ones of ppb or less.

Reference numeral 121 and 122 indicate inert gas sources which supply inert gas to the interior of furnace 130, prevent the oxidation of the outer surface of stainless steel pipe 101, and furthermore, prevent burning.

Reference numeral 102 indicates a heater.

Using the device shown in FIG. 1, a passivated film is formed according to the following procedure.

That is to say, using an inert gas (for example, Ar or He) having an impurity (moisture, hydrocarbons) concentration of less than 10 ppb, the inner surface of a stainless steel pipe 101 is purged, and after moisture has been sufficiently removed, heating to a temperature of approximately 150° C. is conducted and a further purge is conducted, and water molecules adsorbing to the inner surface of this stainless steel pipe 101 are desorbed essentially completely. Next, a mixed gas of oxygen and an inert gas (Ar gas) was introduced and heating was conducted, in accordance with the various conditions shown in Table 1, and a passivated film was formed.

The following test were conducted on stainless steel pipes possessing passivated films formed by means of the above process.

Gas Discharge

Figure 2:
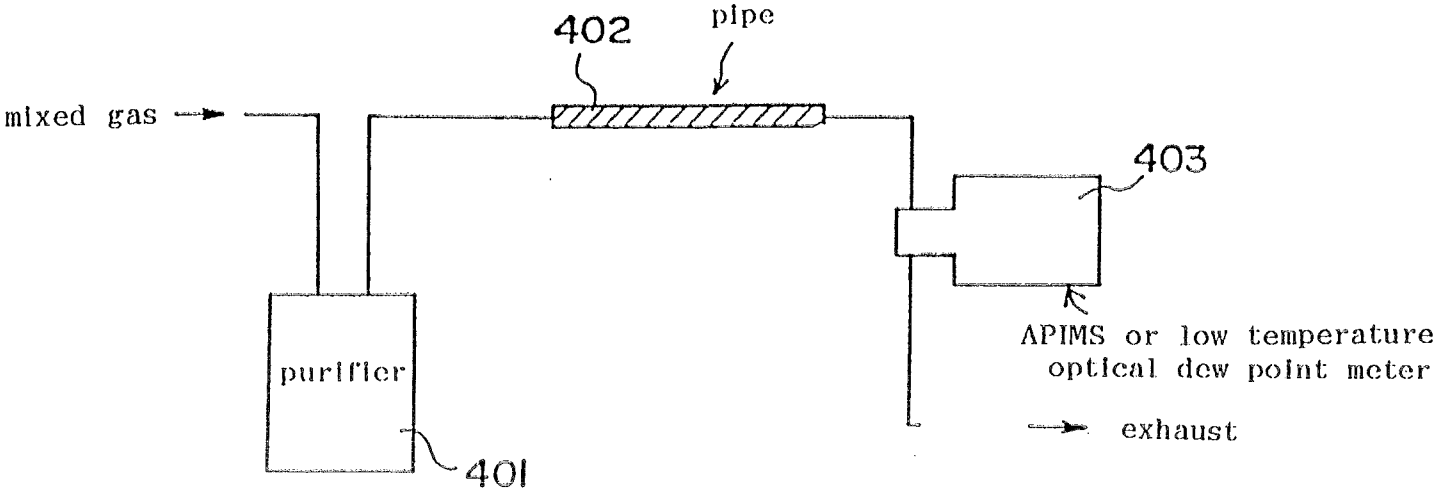
FIG. 2 is a conceptual diagram showing a testing device for resistance to gas discharge.

Resistance to gas discharge was tested by means of the mechanism indicated in FIG. 2. That is to say, a mixed gas of oxygen gas and Ar gas which had been passed through a gas purification device 401 was passed through a stainless steel pipe 402 which was to be tested at a flow amount of 1.2 l/min, and the amount of moisture contained in the gas was measured by means of a APIMS (Atmospheric Pressure Ionization Mass Spectrometer) or low temperature optical dew point instrument 403. The results thereof are shown in FIG. 3.

Crystallization

Crystallization was tested by means of a scanning electron microscope or the like.

Figure 3:
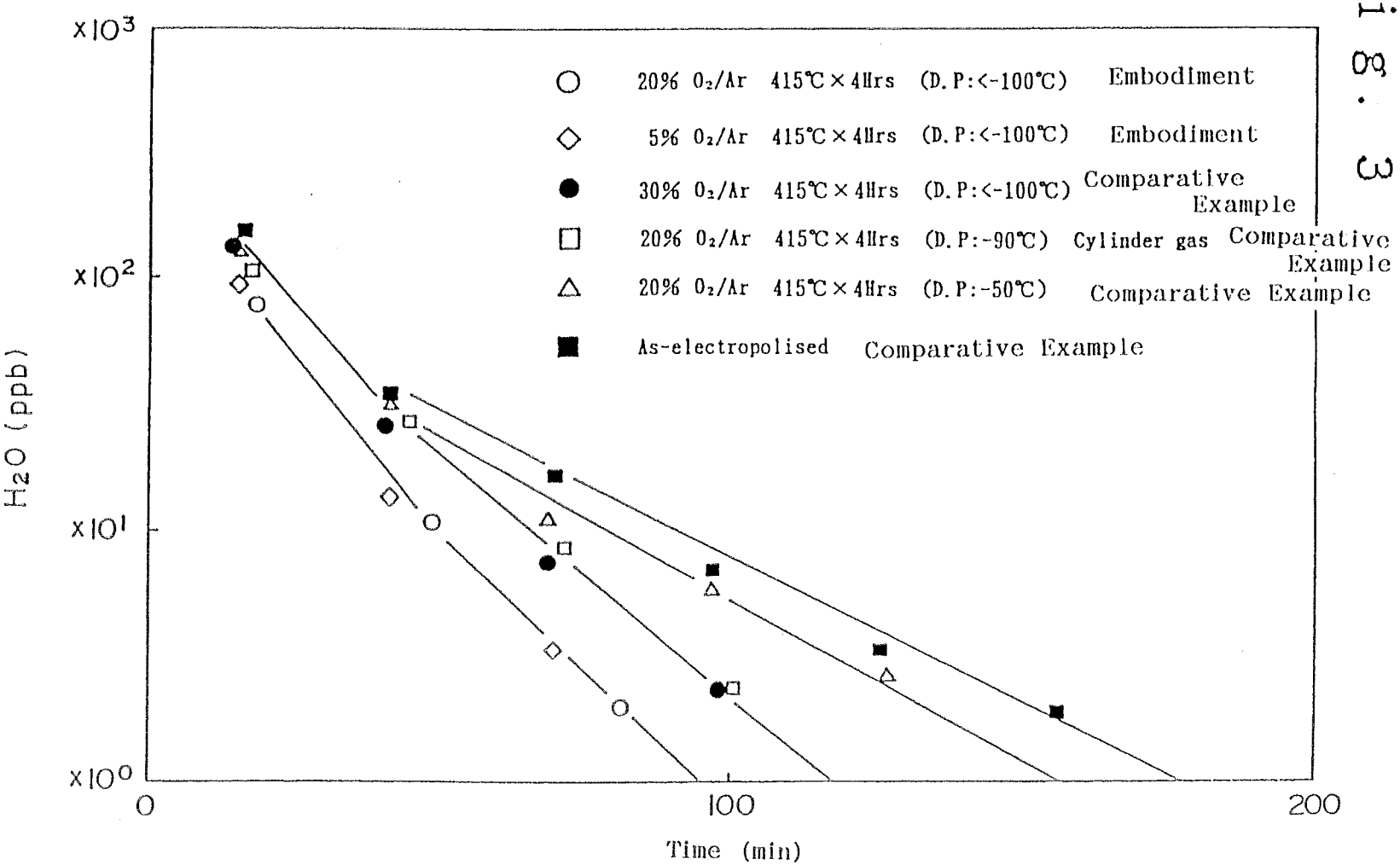
FIG. 3 is a graph showing resistance to gas discharge.
Figure 4A:
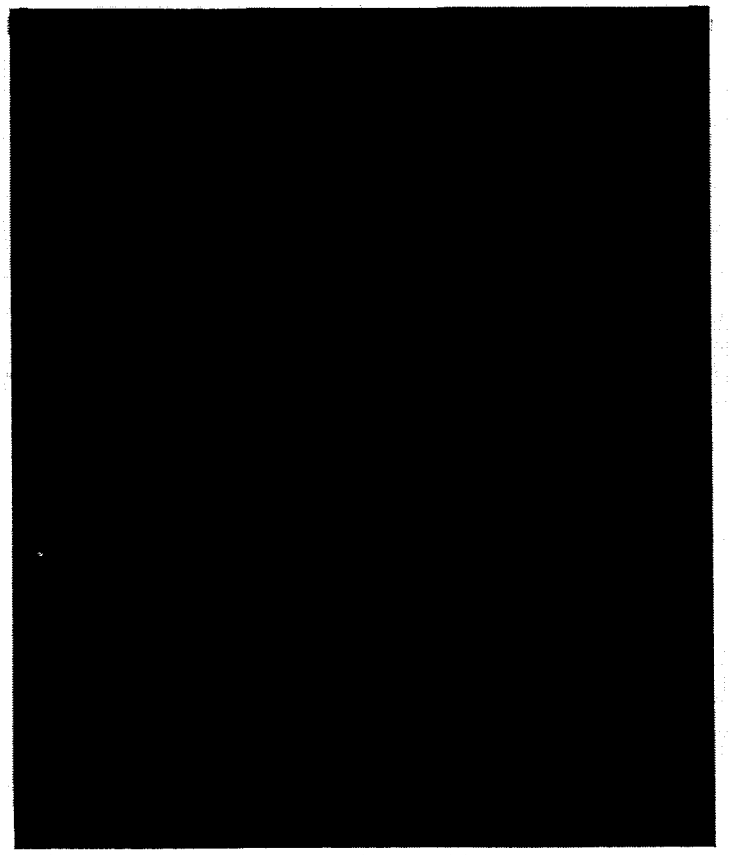
FIG. 4(*a*) and (*b*) are is a scanning electron micrographs of passivated film showing a crystalline structure of the film.
Figure 4B:
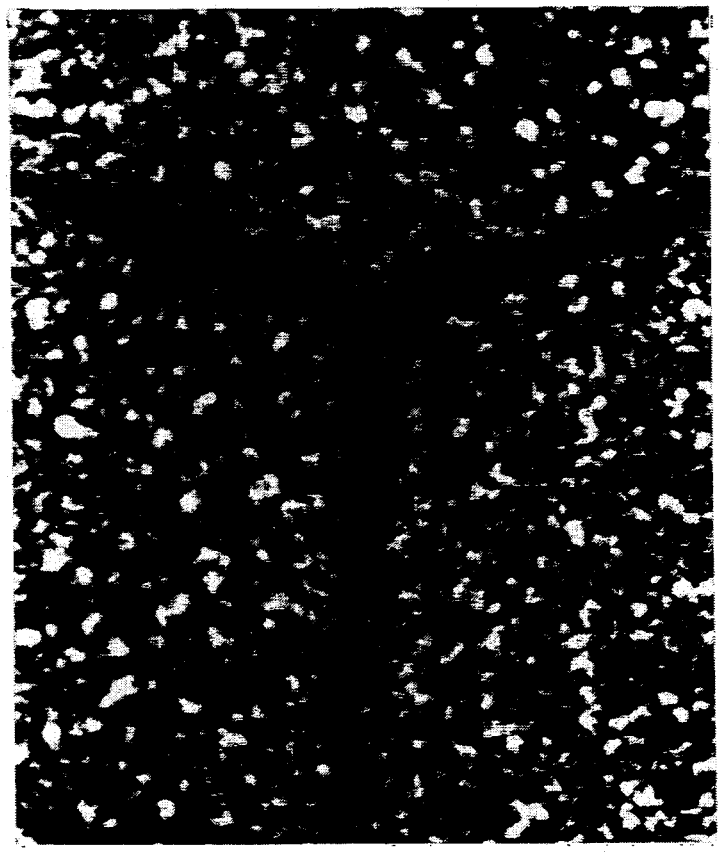
Figure 5:
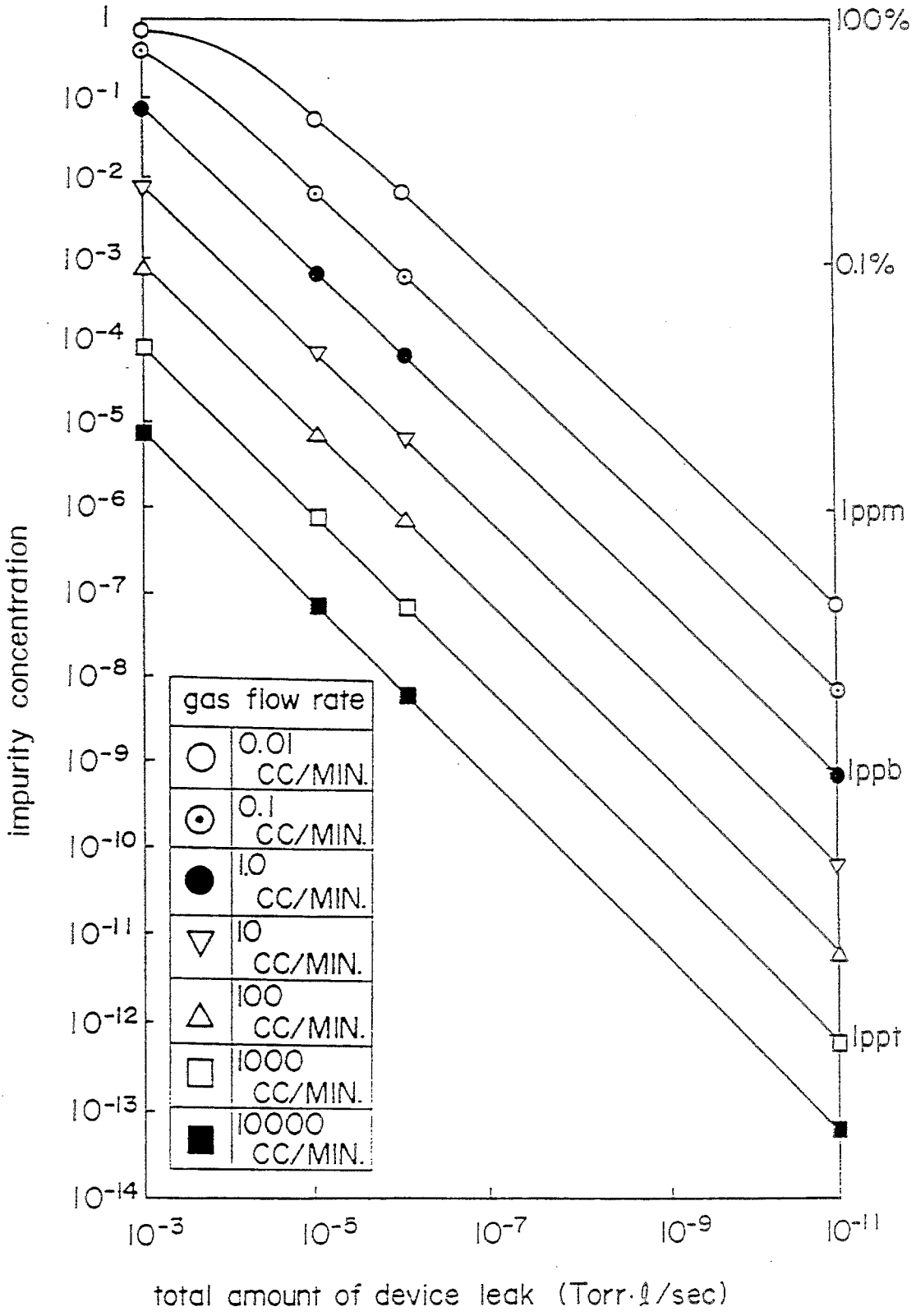
FIG. 5 is a graph showing the relationship between the leakage amount of a conventional gas supply pipe system and impurity concentrations.

The results of the above-described tests are shown in Table 1, FIG. 3, FIG. 4(*a*), and FIG. 4(*b*).

| | No. | Dew-Point Temperature °C. | Impurities Present in Mixed Gas (ppb) | $O_2$ Content | Heating Tempature °C. | Film Quality | Resistance to Gas Discharge |
|---|---|---|---|---|---|---|---|
| Preferred Embodiment | 1 | <−100 | <10 | 20% | 415 | Amorphous | O |
| Preferred Embodiment | 2 | <−100 | <10 | 5% | 415 | Amorphous | O |
| Comparative Example | 3 | <−100 | <10 | 30% | 415 | Amorphous | X |
| Comparative Example | 4 | −90 | >10 | 20% | 415 | Amorphous | X |
| Comparative Example | 5 | −50 | <10 | 20% | 415 | Amorphous | X |
| Preferred Embodiment | 6 | <−100 | <10 | 20% | 350 | Amorphous | O |
| Comparative Example | 7 | <−100 | <10 | 20% | 550 | Crystalline | X |
| Comparative Example | 8 | <−100 | <10 | 20% | 250 | Amorphous | X |
| Preferred Embodiment | 9 | <−110 | <10 | 20% | 415 | Amorphous | OO |

-continued

| | No. | Dew-Point Temperature °C. | Impurities Present in Mixed Gas (ppb) | $O_2$ Content | Heating Tempature °C. | Film Quality | Resistance to Gas Discharge |
|---|---|---|---|---|---|---|---|
| Preferred Embodiment | 10 | <−100 | <10 | 6 ppm | 415 | Amorphous | O |
| Comparative Example | 11 | ... | ... | ... | ... | ... | X |

Resistance to Gas Discharge:
OO = very good,
O = good,
X = poor

As shown in Table 1, preferred embodiments 1, 2, 6, 9, and 10, the dew point temperature, impurities present in mixed gas, oxygen content, and heating temperature of which are all within the prescribed ranges of the present invention, were all superior in resistance to gas discharge. In particular, preferred embodiment 9, the dew point of which was less than −110 ° C., had even more superior resistance to gas discharge.

In preferred embodiment 9, passivating treating was conducted at a temperature of 415° C. and as shown in the scanning electron micrograph of FIG. 4(*a*), the passivated film was an amorphous film possessing minuteness.

In contrast with the above-described preferred embodiments, comparative example 3 has an oxygen content which is greater than the prescribed range of the present invention, comparative example 4 has a dew point temperature higher than the prescribed range of the present invention, and furthermore, has an impurity concentration in the mixed gas which is higher than the prescribed range of the present invention, comparative example 5 has a dew point temperature which is higher than the prescribed range of the present invention, comparative example 7 has a heat treating temperature which is too high, and comparative example 8 has a heat treating temperature which is too low, so that all of these comparative examples had poor resistance to gas discharge.

In comparative example 7, passivating treating was conducted at a temperature of 550° C., and as shown in the scanning electron micrograph of FIG. 4(*b*), this passivated film, in which the particle boundaries can be clearly recognized, has a large crystalline structure. In the case of comparative example 11, comparative example 11 is in an as-electropolished state, that is to say, a state in which passivation treating has not been conducted, so that the resistance to gas discharge thereof was not good.

Possibilities for Use in Industry

In accordance with the present invention, it is possible to form a passivated film possessing superior resistance to gas discharge.

We claim:

1. A method of forming a passivated film on a stainless steel member having a surface roughness, Rmax, of less than 1.0 micrometers, said method comprising heating said stainless steel member to a temperature within a temperature range of between 300° C. and 420° C. in a mixed gas atmosphere, said mixed gas atmosphere comprising an inert gas and oxygen and having an oxygen concentration within an oxygen concentration range of between 5 ppm and 20 volume percent, a dewpoint temperature of less than −95° C., and an impurity concentration of less than 10 ppb, the stainless steel member being heated for a time sufficient to form the passivated film.

2. The method of claim 1 wherein said dewpoint temperature is less than −110° C.

3. The method of claim 1 wherein said impurity concentration is less than 5 ppb.

4. The method of claim 1 wherein the impurity concentration is less than 1 ppb.

* * * * *